United States Patent [19]

Wulff

[11] Patent Number: 4,956,891

[45] Date of Patent: Sep. 18, 1990

[54] FLOOR CLEANER

[75] Inventor: Richard F. Wulff, Maple Plain, Minn.

[73] Assignee: Castex Industries, Inc., Holland, Mich.

[21] Appl. No.: 483,260

[22] Filed: Feb. 21, 1990

[51] Int. Cl.[5] ..... A47L 11/34

[52] U.S. Cl. ..... 15/320; 15/321; 15/353

[58] Field of Search ..... 15/320, 321, 322, 353

[56] References Cited

U.S. PATENT DOCUMENTS

| | | | |
|---|---|---|---|
| 1,240,799 | 9/1917 | Gray | 15/320 |
| 1,690,472 | 11/1928 | Breton | 15/384 |
| 1,975,380 | 10/1934 | Streich et al. | 15/59 |
| 2,731,659 | 1/1956 | Coplen | 15/320 |
| 3,010,129 | 11/1961 | Moore | 15/1 |
| 3,011,206 | 12/1961 | Breither | 15/320 |
| 3,060,484 | 10/1962 | Krammes | 15/320 |
| 3,117,337 | 1/1964 | Krammes | 15/320 |
| 3,277,511 | 10/1966 | Little et al. | 15/320 |
| 3,402,420 | 9/1968 | Schaeffer | 15/320 |
| 3,584,330 | 6/1971 | Wallin et al. | 15/375 |
| 3,699,607 | 10/1972 | Putt | 15/320 |
| 3,720,977 | 3/1973 | Brycki | 15/321 |
| 3,755,850 | 9/1973 | Porter | 15/320 |
| 3,761,987 | 10/1973 | Nayfa et al. | 15/50 |
| 3,848,290 | 11/1974 | Bates | 15/300 |
| 3,931,662 | 1/1976 | Nayfa et al. | 15/320 |
| 4,000,536 | 1/1977 | Nayfa et al. | 15/320 |
| 4,000,538 | 1/1977 | Tissier | 15/320 |
| 4,014,067 | 3/1977 | Bates | 15/320 |
| 4,114,229 | 9/1978 | Jones et al. | 15/320 |
| 4,139,922 | 2/1979 | Fitch | 15/321 |
| 4,156,952 | 6/1979 | Lynch, Jr. | 15/320 |
| 4,182,001 | 1/1980 | Krause | 15/320 |
| 4,196,492 | 4/1980 | Johnson et al. | 15/320 |
| 4,200,951 | 5/1980 | Burgoon et al. | 15/320 |
| 4,210,978 | 7/1980 | Johnson et al. | 15/320 |
| 4,308,636 | 1/1982 | Davis | 15/321 |
| 4,333,202 | 6/1982 | Block | 15/320 |
| 4,542,556 | 9/1985 | Hepple | 15/321 |
| 4,667,364 | 5/1987 | Meili | 15/320 |
| 4,759,094 | 7/1988 | Palmer et al. | 15/320 |
| 4,809,397 | 3/1989 | Jacobs et al. | 15/320 |
| 4,817,233 | 4/1989 | Waldhauser | 15/320 |

FOREIGN PATENT DOCUMENTS

| | | |
|---|---|---|
| 0104345 | 4/1984 | European Pat. Off. . |
| 2305396 | 2/1973 | Fed. Rep. of Germany . |

*Primary Examiner*—Chris K. Moore

*Attorney, Agent, or Firm*—Price, Heneveld, Cooper, DeWitt & Litton

[57] ABSTRACT

A five in one floor cleaning machine supported on wheels intermediate the front and rear of the machine, there being adjacent the rear a clean water outlet, a scrub brush, a dirty water pickup nozzle, a clean rinse water outlet, and a dirty rinse water pickup nozzle. A pair of concentric chambers retain the clean and dirty water, the first chamber surrounding an inner chamber which is defined by a flexible spherical wall. As clean water empties from one chamber, and dirty water fills the other, the center of gravity stays substantially the same. The flexible wall of the inner chamber folds in under the force of surrounding increasing water pressure to decrease the size of the inner chamber as it empties of clean water.

18 Claims, 6 Drawing Sheets

FLOOR CLEANER

BACKGROUND OF THE INVENTION

This invention relates to floor cleaning machines and particularly to five in one floor cleaning machines wherein clean water is progressively converted to dirty or spent water, all retained by the machine which is self contained.

Of the variety of floor cleaning machines devised over the past several decades, a few have suggested a five in one cleaning concept for cleaning carpet or other floor covering materials. Such a concept involves the steps of (1) applying clean wash water solution to an area of the floor, (2) scrubbing the floor with this clean wash water solution, (3) vacuuming the dirty, i.e., spent, wash water off the floor area, (4) applying clean rinse water to the floor area, and (5) vacuuming the spent rinse water from the floor, all in one pass. A substantial part of the weight load of such a floor cleaning machine is that of the clean and dirty water. Floor cleaning machines have part of the load thereof applied to a pair of wheels and part applied to the scrub brush and vacuum nozzles on the floor. The use of an axle and wheels allows the machine to be tilted for lifting of the scrub brush and vacuum nozzles off the floor for ready traverse to the desired location as for cleaning. The load applied at the brush enables it to scrub effectively.

The water load in such machines is very substantial. During use, the weight of this water is progressively transferred from the clean water vessel to the dirty or spent water vessel. This transfer normally causes a consequential change in the amount of load applied to the scrub brush and nozzles against the floor. This change causes the nature of the cleaning action to constantly change during operation. This is because the center of gravity of the load changes during water transfer.

SUMMARY OF THE INVENTION

The present invention is a five in one floor cleaning machine wherein the amount of load applied at the brush and vacuum nozzles to the floor remains substantially constant during the entire cleaning process. The clean hot water for cleaning and rinsing is in a chamber surrounded by a dirty or spent water chamber. The inner chamber is formed of flexible walls which can collapse as the quantity of dirty water in the outer chamber around the inner chamber increases progressively while cleaning occurs. The center of gravity of the entire load stays substantially constant as clean water is converted to dirty water.

The floor cleaning machine can be pulled by a handle across the floor surface to be cleaned, having wheels and an axle intermediate its front and rear, and having a clean water outlet, a powered scrub brush, a dirty water suction inlet, a clean rinse water outlet, and spent rinse water suction inlet, all arranged in series between the wheels and the rear of the machine so as to enable cleaning and rinsing in one pass of the machine. The outer, dirty water chamber and inner, clean water vessel therein are located with a common center of gravity to the rear of the axle a sufficient amount to apply a predetermined constant load on the brush and nozzles over the length of the cleaning cycle.

DESCRIPTION OF THE PREFERRED EMBODIMENT

Figure 1:
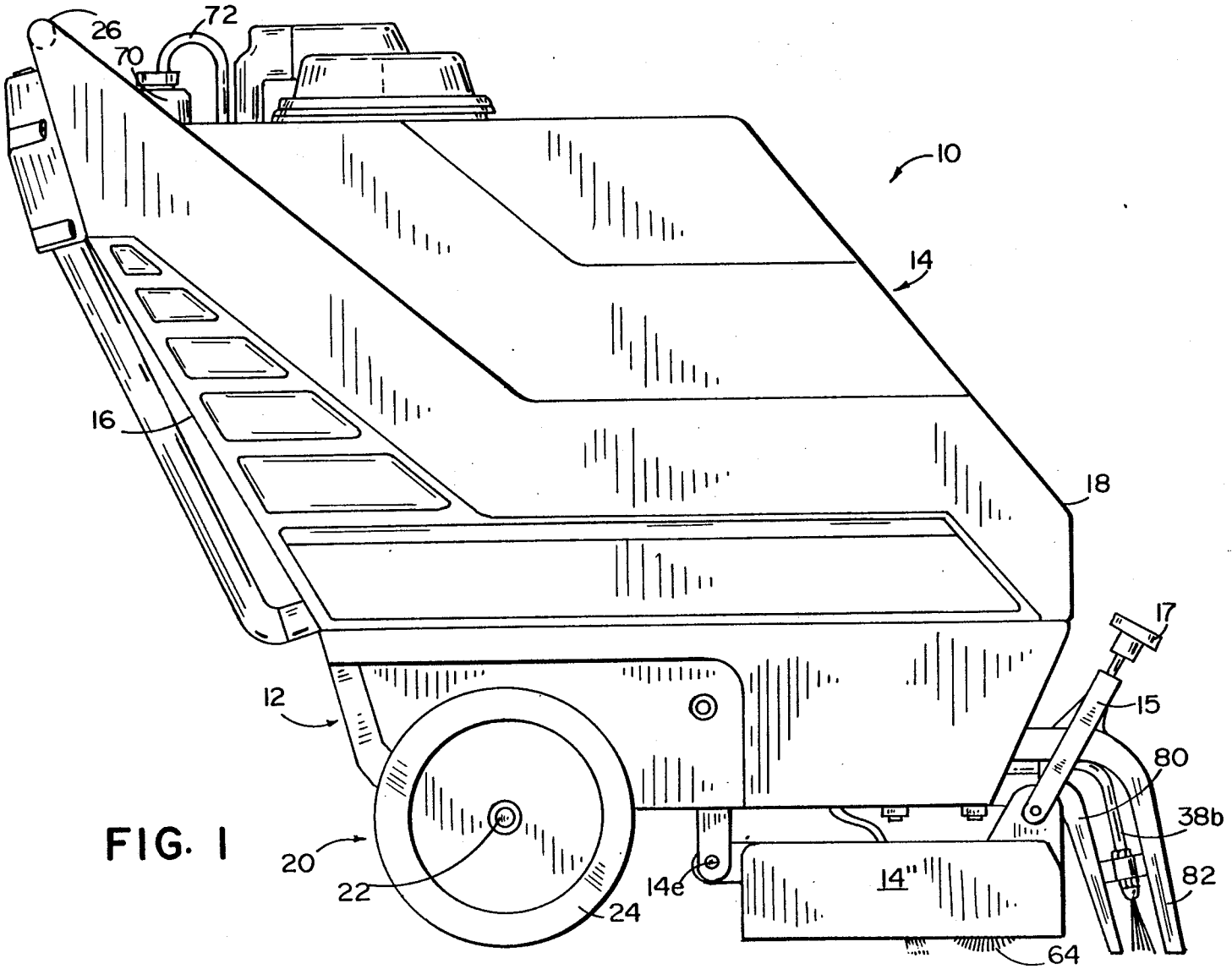
FIG. 1 is a side elevational view of the five in one cleaning machine employing the present invention.
Figure 3:
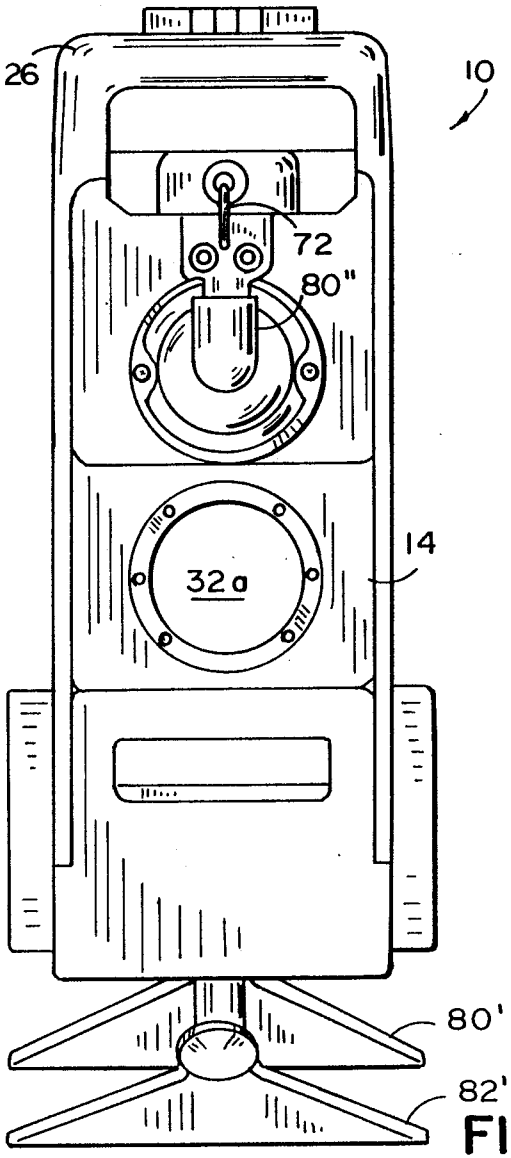
FIG. 3 is a top plan view of the machine in FIG. 1.
Figure 2:
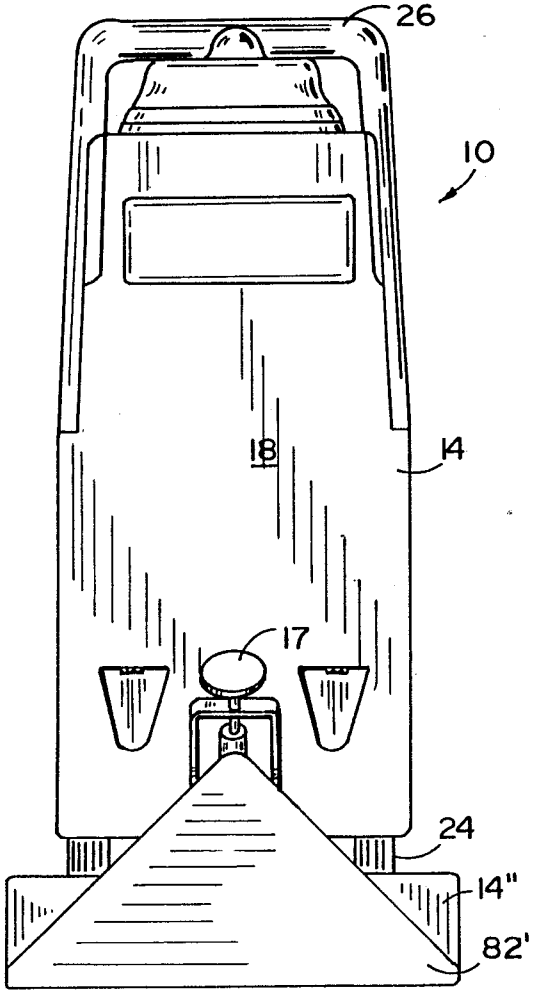
FIG. 2 is a front elevational view of the machine in FIG. 1.

The complete five in one floor cleaning machine 10 includes a support structure 12 comprising metal framework components, and a housing 14 as of molded polymeric material. The machine will be explained using end 16 as a front end, and end 18 as a rear end of the machine. Beneath the support structure is wheel means 20 including an axle 22 transverse of the longitudinal direction of the machine and a pair of wheels 24 on opposite ends of the axle, i.e., at the sides of the machine. At the front of the machine is a handle 26 for manually grasping thereof and pulling the cleaning machine in the cleaning direction depicted by an arrow in FIG. 10. The wheels and axle are intermediate the front and rear of the machine, enabling the machine to be tilted about this axle by pulling down on front handle 26 to lift the cleaning mechanism at the rear of the machine off the floor, e.g., off a carpet, for ready traverse of the floor surface.

Figure 4:
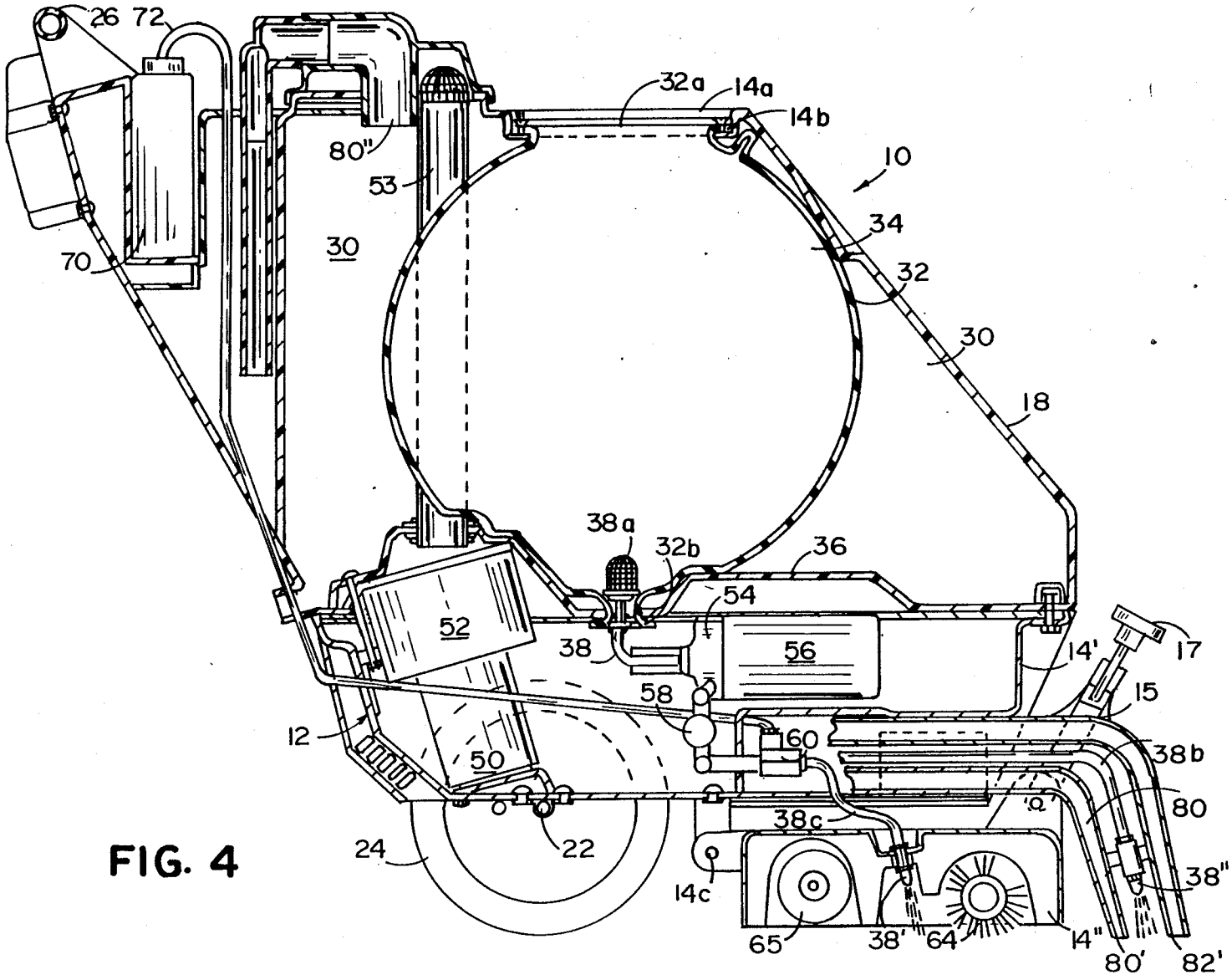
FIG. 4 is a sectional side elevational view of the machine in FIG. 1.
Figure 7:
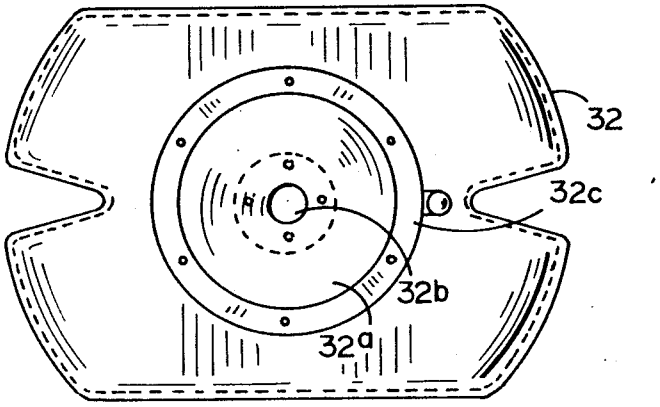
FIG. 7 is a top plan view of the container in FIG. 6.
Figure 6:
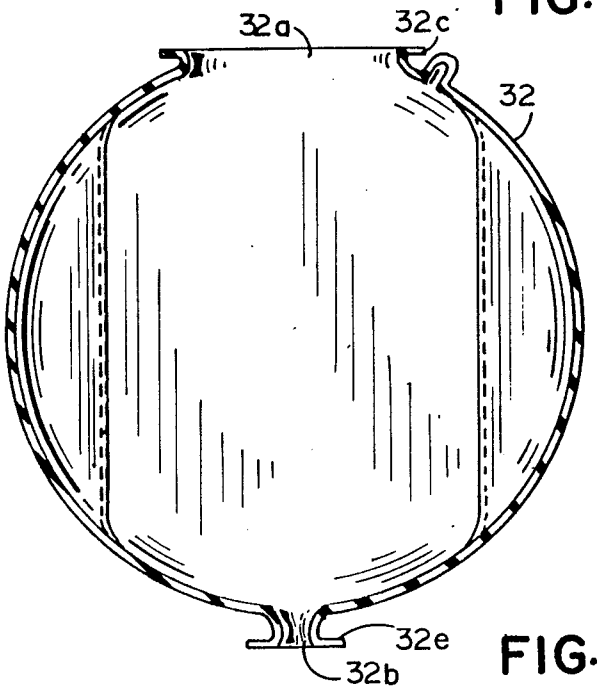
FIG. 6 is a side elevational view of the inner clean water container.
Figure 10:
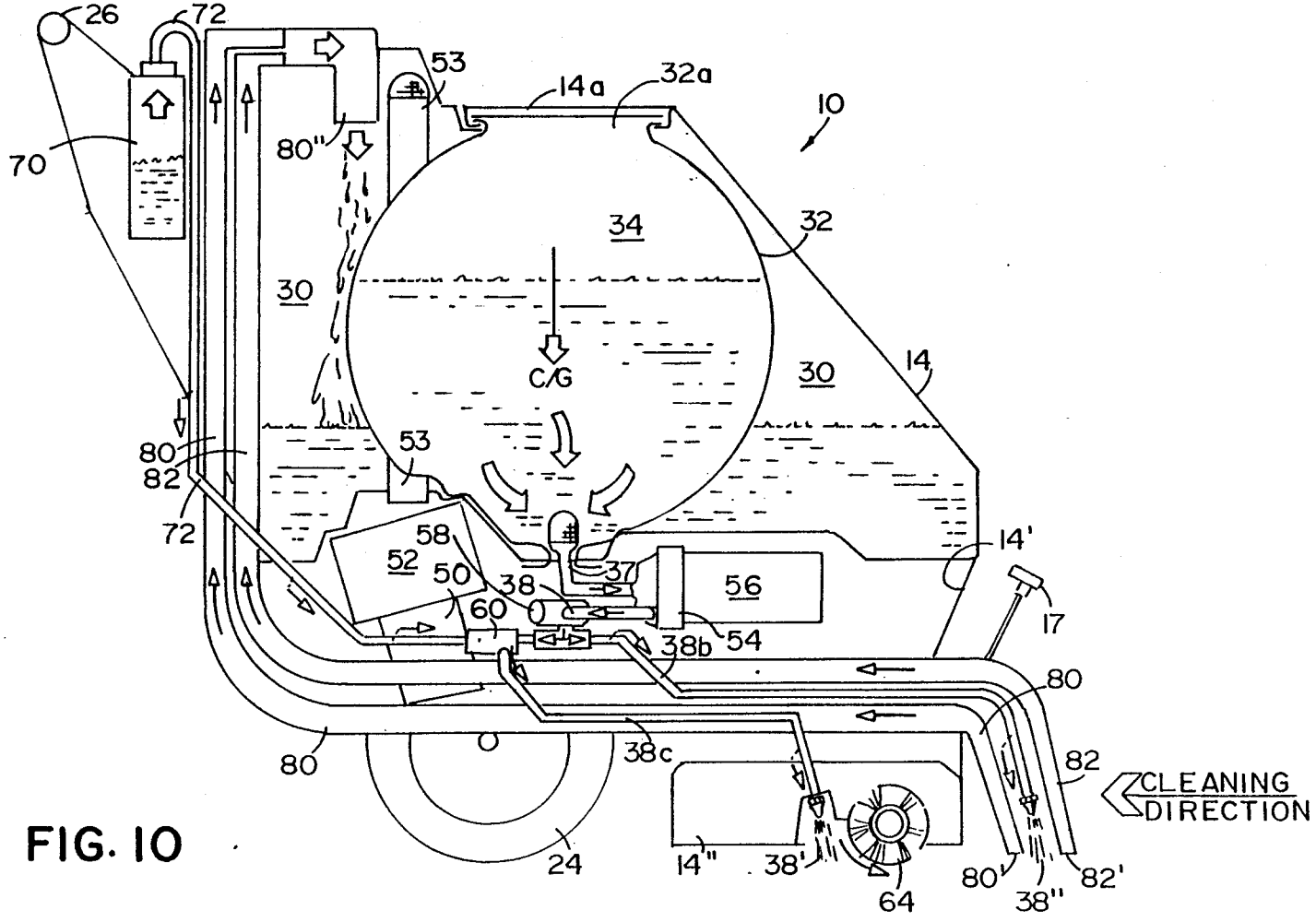
FIG. 10 is a side elevational, partially diagrammatic view of the machine showing the nature of the operation thereof.

Housing 14 defines an outer chamber 30 (FIG. 4) for collecting dirty or spent water therein. This housing thus forms a first outer container. Within housing 18 is an inner container 32 defining an inner chamber 34. This inner container 32 is made of flexible, reinforced rubber walls which, when fully expanded, appear from the side (FIGS. 4, 6 and 10) to be generally spherical (FIG. 4). Viewed from the front (FIG. 7), container 32 shows its generally flat side walls which can expand against the side walls of housing 14. These flat side walls are in the nature of chordal flats relative to the curved ends (FIG. 7). Viewed from the top, the convexly curved end walls of container 32 are shown to possess two vertical recesses in the front and rear thereof (FIG. 7). The front recess fits around standpipe 53 (FIG. 4). Container 32 has an upper opening **32*a* coincident with opening 14*a* in housing 14 for allowing hot clean water to be poured down into chamber 34. A cover (not shown) can be placed over these aligned openings. The upper end of container 32 is secured to housing 14 at a peripheral housing flange 14*b*. This attachment is achieved by bolting through flange 14*b* and an outwardly protruding flange 32*c* (FIG. 6) around opening 32*a*. The bottom of container 32 rests upon a partition 36 which forms the bottom of outer chamber 30. At the very bottom of inner container 32 is a clean water outlet 32*b*** to a conduit 38. This outlet has a screen strainer 38*a* (FIG. 4). The bottom of container 32 also has a flange 32*e* (FIG. 6) around opening 32*b* for sealing to housing partition 36 by an annular clamp 37 (FIG. 10).

The flexible walls of this container are preferably made of a reinforced polymeric material expandable to the illustrated partial spherical configuration when filled with water, but flexible to collapse progressively under hydrodynamic pressure as the outer chamber fills with spent water and the inner chamber empties of clean water. Reinforced rubber is the presently preferred reinforced polymer.

Contained within the lower housing 14' beneath partition 36 is a vacuum pump 52 and its motor 50, and a water pump 54 and its motor 56. Pump 54 is connected into conduit 38 to pump clean water, preferably hot water, from chamber 34 through conduit 38 to two different places. Conduit 38 is controlled by a solenoid valve 58 thereon to allow or not allow water flow to these two different places (see arrows in FIG. 10), one being through subconduit 38*c* past a chemical injection valve 60 to outlet nozzles 38' across the width of the machine toward the rear thereof. This is to apply clean water solution containing cleaning chemicals to the floor surface to be scrubbed. A chemical concentrate container 70 in a convenient location up near the handle is connected by a conduit 72 to the chemical injection valve 60, the chemical flowing by suction to this location. The other subconduit 38*b* extends to rinse outlet nozzles 38" extending across the machine to apply rinse water to the floor surface. Immediately behind nozzles 38' is a power operated scrub brush 64 shown to comprise a horizontal cylindrical brush on a transverse axis for scrubbing the floor. Cylindrical brush 64 is operated by a motor 65 via a drive belt (not shown) or the equivalent. There is also an underslung housing 14" pivotally mounted to the framework at transverse pivot axis 14*c*, toward the front end of this subhousing. The rear end of housing 14" has a vertically adjustable height via linkage 15 connected to a threaded shaft with an adjustment knob 17. Nozzles 38', brush 64 and motor 65 are in housing 14". Adjustment of knob 17 allows brush 64 to have a controlled amount of bias against the floor surface being cleaned.

Figure 9:
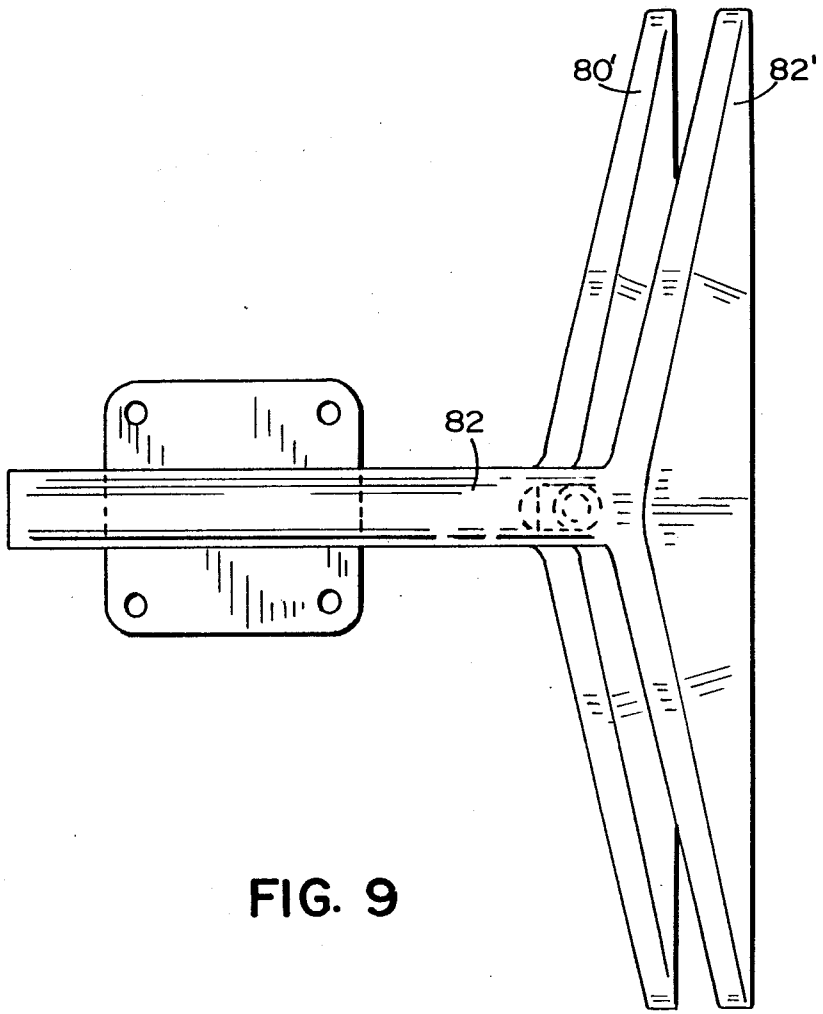
FIG. 9 is a top plan view of the vacuum nozzles of the apparatus.
Figure 5:
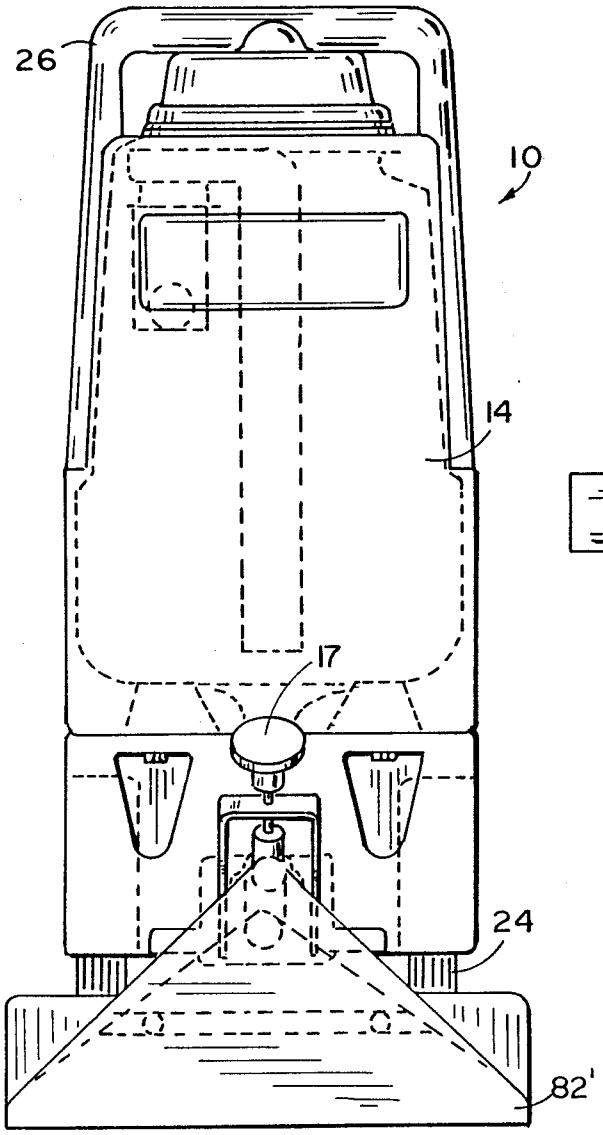
FIG. 5 is a rear elevational view of the machine in FIG. 1.
Figure 8:
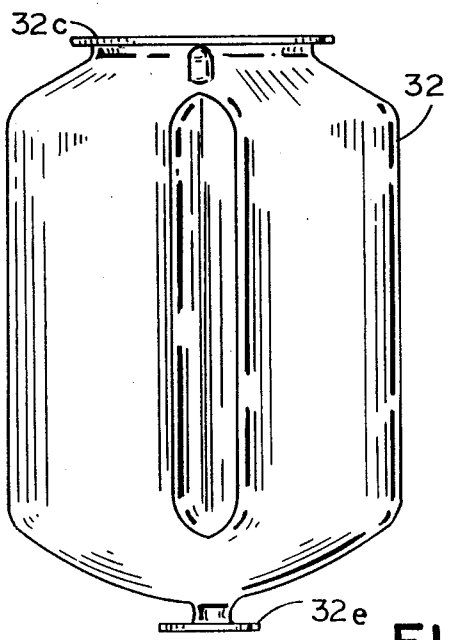
FIG. 8 is a front elevational view of the container in FIGS. 6 and 7.

At the rear of the machine, i.e., behind scrub brush 64, is a pair of transversely extending elongated vacuum pickup inlets astraddle of outlet nozzles 38". More specifically, a transverse first pickup inlet nozzle 80' (FIGS. 4 and 9) located behind scrub brush 64 and forwardly of rinse spray nozzles 38" is on conduit 80 which extends forwardly and then upwardly to a discharge outlet 80" into the forward part of outer chamber 30. Similarly, transverse vacuum nozzle 82', which is located rearwardly of the rinse water spray nozzles 38" to pick up the spent rinse water, has its bottom surface generally coplanar with nozzle 80'. It is on conduit 82 which extends forwardly and then upwardly at the front of the machine to discharge outlet 80" into chamber 30. This flow of the spent wash water and spent rinse water into outer chamber 30 is caused by a partial vacuum in chamber 30 created by vacuum pump 52 and its motor 50 via standpipe 53. Standpipe 53 has a screened upper open end into chamber 30.

The location of outer chamber 30 and inner chamber 34 are such as to cause the center of gravity of the two chambers to generally coincide and be centrally of chamber 34 (as indicated by the arrow in FIG. 10), whether the outer chamber is empty and the inner chamber full of clean water, or the inner chamber empty and the outer chamber full of spent water, or at any stage therebetween when these two chambers both contain water.

At the start of the cleaning operation, chamber 34 is filled with clean water, preferably heated. Container 32 is thus fully expanded to its partly spherical shape, its flat side walls lying against the housing side walls, and its front and rear ends, top and bottom being convexly curvilinear. The machine, with the motors operating, has scrub brush 64 vertically adjusted by knob 17 to the desired elevation relative to nozzles 80' and 82'. The operator initially utilizes handle 26 to pull the machine in a tilted condition on wheels 24, i.e., with the brush and vacuum nozzles off the floor, to the location where cleaning is to begin. The operator then tilts the machine back to lower scrub brush 64 and nozzles 80' and 82' to the floor surface, e.g., carpet, and activates solenoid 58 to cause pump 54 to draw clean water from chamber 34 through conduit 38. The clean water thus flows to both conduit parts 38*c* and 38*b*. In 38*c*, cleaning chemical is injected from container 70 through valve 60 to thus cause pump 54 to force cleaning fluid through nozzles 38' onto the floor surface. Simultaneously, clean rinse water through conduit 38*b* is ejected from nozzles 38". As the machine is pulled, scrub brush 64 operates on the floor to scrub it, with pickup nozzle 80' thereafter vacuuming the dirty wash water and transferring it to conduit 80 where it flows into evacuated chamber 30. Rinse water is ejected through nozzle 38" onto the washed and vacuumed floor to apply rinse water thereto, such rinse water being subsequently drawn up by nozzles 82' into conduit 82 to chamber 30.

As clean water is progressively depleted from chamber 34, and spent dirty water fills chamber 30, the hydrodynamic pressure of the dirty water causes flexible walls 32 to progressively collapse, while the center of gravity of the water remains substantially the same at the center of chamber 34 (FIG. 10). This center of gravity is in a vertical plane transverse to the longitudinal direction of movement of the machine, between the wheel axle and the scrub brush. Preferably the center of gravity is offset rearwardly of the axle less than 50% of the distance from the axle to the transverse scrub brush axis, and most preferably less than 20% of that distance. Thus the load applied at the scrub brush and the vacuum nozzles on the floor remains substantially constant throughout the cleaning operation. When the clean water has all been utilized, the dirty water is drained out through a suitable outlet (not shown).

Conceivably certain details of the preferred embodiment set forth as exemplary of the invention could be modified to suit a particular type of floor surface or circumstance. It is not intended that the invention be limited specifically to the exemplary embodiment depicted, but only by the scope of the appended claims and the reasonably equivalent structures to those defined therein.

The embodiments of the invention in which an exclusive property or privilege is claimed are defined as follows:

1. A floor cleaning machine comprising:

a support structure including a housing thereon forming a front and a rear for said machine;

wheel means having an axle means beneath said support structure on a transverse axis intermediate said front and said rear for mobility of said machine;

handle means at the upper front of said machine for moving said machine;

floor engaging cleaning means adjacent said rear for cleaning the floor, including a clean water outlet and a dirty water inlet;

said housing having a first water retention chamber with a center of gravity rearward of said axis and substantially forward of said floor engaging cleaning means;

an inner container within said first chamber defining an inner chamber for retention of water separated from water in said first chamber;

said inner chamber being substantially symmetrical with said center of gravity;

clean water conduit means between one of said chambers and said floor engaging cleaning means clean water outlet for conducting clean water to said floor engaging cleaning means;

dirty water conduit means between the other of said chambers and said floor engaging cleaning means dirty water inlet to conduct dirty water from said dirty water inlet to said other chamber;

said first chamber extending in front of and to the rear of said inner chamber, said first chamber and said inner chamber being located and configured to cause said center of gravity to remain substantially constant during emptying of said one chamber of clean water and filling of said other chamber of dirty water, such that downward force on said floor engaging cleaning means remains substantially constant throughout the cleaning cycle.

2. The floor cleaning machine in claim 1 wherein said outer chamber surrounds said inner container.

3. The floor cleaning machine in claim 1 wherein said inner container has flexible wall structure enabling water in said outer chamber and said inner chamber to shift said flexible wall structure as said one chamber is emptied and said other chamber is filled, without substantially shifting said center of gravity.

4. The floor cleaning machine in claim 3 wherein said first chamber surrounds said inner container.

5. The floor cleaning machine in claim 4 wherein said inner container is of partial spherical configuration.

6. The floor cleaning machine in claim 1 including a pump associated with said clean water conduit means for pumping clean water to said clean water outlet.

7. The floor cleaning machine in claim 6 including a vacuum pump operably associated with said other chamber to draw dirty water from said dirty water inlet means to said other chamber.

8. The floor cleaning machine in claim 1 wherein said floor engaging cleaning means includes a power brush.

9. The floor cleaning machine in claim 1 wherein said first chamber is the dirty water retention chamber and said inner chamber is the clean water retention chamber.

10. The floor cleaning machine in claim 9 wherein said outer chamber surrounds said inner container.

11. The floor cleaning machine in claim 10 wherein said inner container has flexible wall structure enabling water in said outer chamber and said inner chamber to shift said flexible wall structure as said one chamber is emptied and said other chamber is filled, without substantially shifting said center of gravity.

12. The floor cleaning machine in claim 11 wherein said inner container is of partial spherical configuration.

13. The floor cleaning machine in claim 12 including a pump associated with said clean water conduit means for pumping clean water to said clean water outlet; and a vacuum pump operably associated with said other chamber to draw dirty water from said dirty water inlet means to said other chamber.

14. The floor cleaning machine in claim 13 wherein said floor engaging cleaning means includes a power brush.

15. A five in one floor cleaning machine comprising:

a support structure including a housing forming a front and rear of said machine;

wheel means having an axle intermediate said front and rear for mobility of said machine;

handle means for moving said machine over a floor surface;

floor engaging cleaning means adjacent said rear for cleaning the floor and comprising a clean water outlet, a powered scrubbing brush adjacent said clean water outlet, a first vacuum nozzle having a dirty water inlet behind said scrubbing brush, a rinse water outlet behind said dirty water inlet, and a second vacuum nozzle having a dirty rinse water inlet behind said rinse water outlet, said brush and said first and second vacuum nozzles engageable with the floor and partially supporting said machine;

said housing having a first water retention chamber;

an inner container within said first chamber said first chamber surrounding said second chamber;

both said first and second chambers having a center of gravity on substantially the same vertical plane which is transverse to a plane extending between said front and said rear, said vertical plane being to the rear of said wheel axis and substantially forward of said vacuum nozzles; and both said first and second chambers maintaining substantially the same common center of gravity during emptying of one chamber and filling of the other chamber during the cleaning operation.

16. The floor cleaning machine in claim 15 wherein said inner chamber is of partial spherical configuration.

17. The floor cleaning machine in claim 16 wherein said inner container has flexible wall structure enabling water in said outer chamber and said inner chamber to shift said flexible wall structure as said one chamber is emptied and said other chamber is filled, without substantially shifting said center of gravity.

18. The floor cleaning machine in claim 17 wherein said inner container is for retaining clean water and said first chamber is for receiving dirty water;

clean water conduit means from said inner container to said clean water outlet for conducting clean water thereto, and to said rinse water outlet for conducting clean rinse water thereto;

cleaning chemical injection means to said clean water conduit means to said clean water outlet for injecting cleaning chemical;

dirty water conduit means from said dirty water inlet to said first chamber and from said dirty rinse water inlet to said first chamber, for conducting dirty water thereto;

said first chamber being filled as said inner chamber is emptied while maintaining said center of gravity substantially constant in said vertical plane.

* * * * *

UNITED STATES PATENT AND TRADEMARK OFFICE

CERTIFICATE OF CORRECTION

PATENT NO. : 4,956,891

DATED : September 18, 1990

INVENTOR(S) : Richard F. Wulff

It is certified that error appears in the above-identified patent and that said Letters Patent is hereby corrected as shown below:

Column 6, line 29:
After "chamber" insert --defining a second water retention chamber;"

Signed and Sealed this

Seventeenth Day of March, 1992

*Attest:*

HARRY F. MANBECK, JR.

*Attesting Officer*

*Commissioner of Patents and Trademarks*